United States Patent [19]

Suhling

[11] 4,216,689

[45] Aug. 12, 1980

[54] WEIGHT CONTROLLED BREAD LOAF SLICER

[76] Inventor: Peter Suhling, Gottlieb-Daimler-Strasse 24, 2805 Brinkum-Nord, Fed. Rep. of Germany

[21] Appl. No.: 922,242

[22] Filed: Jul. 6, 1978

[30] Foreign Application Priority Data

Jul. 8, 1977 [DE] Fed. Rep. of Germany ..... 2730843

[51] Int. Cl.[2] ..... B26D 4/56; B26D 4/46

[52] U.S. Cl. ..... 83/77; 83/91; 83/95; 83/84; 83/161

[58] Field of Search ..... 83/77, 90, 95, 84, 86, 83/91, 161

[56] References Cited

U.S. PATENT DOCUMENTS

| | | | |
|---|---|---|---|
| 1,286,453 | 12/1918 | van Berkel | 83/91 |
| 2,281,439 | 4/1942 | Heftler | 83/95 X |
| 3,846,957 | 11/1974 | Divan | 83/77 X |

*Primary Examiner*—Donald R. Schran

*Attorney, Agent, or Firm*—Sughrue, Rothwell, Mion, Zinn and Macpeak

[57] ABSTRACT

Bread loaves 12 are fed by spiked conveyor 13 into a slice cutter 14 and then to a pocket 29 on an indexing turret 16, where the slices are impaled on parallel pins 31. When the turret intermittently rotates a pusher 34 strips the slice group from the pins, and they are transferred to a weighing conveyor 17. The output from the latter controls the feed rate to maintain the weight of each slice group at a predetermined value.

29 Claims, 4 Drawing Figures

WEIGHT CONTROLLED BREAD LOAF SLICER

BACKGROUND OF THE INVENTION

This invention relates to an apparatus for making a number of sliced portions of specific weight from a cuttable product, more particularly for making one-pound cut-bread portions for packing from loaves.

Devices of this kind, particularly for cutting foods such as bread, cheese, sausage and meat products etc., are used, for example in installations for making cut bread up into portions.

In the installations of this kind on the market, loaves of a length of about 1.1 m are fed by a feeder to a cutter which cuts the loaf into slices of a specific thickness.

Cutting is usually carried out with a sickle-shaped or circular blade which rotates at a speed of about 500 rpm and more about the blade axis and accordingly cuts some eight or nine slices per second.

The cutter blade or cutter blade shaft is usually driven by an electric motor via an output shaft on which a first gearwheel is fixed, which meshes with a second gearwheel which is in turn connected to the usually epicyclic cutter blade.

The above two gearwheels are also interconnected via a crank so that the superimposition of the two movements arising out of the above-described structural features produces a rotary movement on the one hand and a planetary movement on the other hand for the cutter blade about the cutter blade shaft.

The feeder supplying the product—i.e. the loaves in the case of a cut-bread batching device—to the cutter unit preferably engages the product positively to prevent the product from receding when the cutter blade engages it, and to ensure uniform slice thickness, and is accordingly preferably constructed as a spiked chain or the like.

In machines of this kind on the market, the slices are carried off by means of a conveyor, the conveying speed of which—like the conveying speed of the feeder—is usually controllable, in order thus to provide a buffer effect and keep the cut slices in mutual contact.

The conveyor for carrying off the portions is usually attended by an operator who rejects the crusts at the beginning and end of each loaf as being unusable for the portions.

The operator also takes a specific number of slices for packing—e.g. some 10 to 13 slices for a one-pound portion—and also is required to check the total weight of the resulting portion on a weighing machine. If the weight is below the predetermined portion weight, then the operator will add one or two slices to the portion. If, on the other hand, the portion weight recorded by the weighing unit is above the predetermined required weight, the operator will remove one or more slices from the pile.

The portion consisting of the slices of bread is then placed on the actual conveyor for carrying the slices off or placed in a box thereon and conveyed to the packing station.

It has been found in practice that the operators frequently omit the weighing operation and rely simply on "feel" or their experience as to how the portion looks in respect of the required weight. Consequently, the individual portions of bread frequently have considerable differences in weight, overweight generally being involved in view of the regulations, because underweight portions must be avoided under the statutory provisions. This recurrent or very frequent overweight means considerable losses for the baker, because the price of the portion is calculated according to the intended weight.

The literature also discloses a device of the above-described type in which the required weight of a portion is varied by way of the slice thickness either instead of or in addition to by way of the number of slices. When the portion weight or part portion weight resulting from a specific number of slices is reached, the weighing unit transmits it as an actual value to a comparator, which also receives the set-value and which in turn acts on the speed of advance of the conveyor—via a separate control system if required—and either increases or reduces it according to the actual value signalled, in order thus to increase or reduce the thickness of the slice and hence provide a correspondingly corrected portion actual weight.

The disadvantages of the first apparatus described and of the method which can be performed with this known apparatus have already been indicated above and are obvious so that they need not be discussed in detail here. We will simply point out briefly that the known device is relatively expensive as regards its operating costs in view of the personnel required, while in addition its output is relatively limited, because an operator can of course only achieve a specific capacity. This is the reason for the inaccuracy already indicated above and the resulting cost. In addition, this known method of operation is not very hygienic in view of the use of the operator's hands.

With regard to the second known method described, in which the slice thickness is variable to obtain the most accurate possible portion weight under the control of the weigher unit, no apparatus has hitherto been disclosed for performing this method to satisfy the requirements in respect of operational reliability, handling of the product, slices and portions etc., while at the same time giving a high output equivalent at least to the cutting capacity of the cutter unit with which it is today possible, as already indicated above, to produce eight or more slices per second in the case of a loaf as the product. With other products the cutting capacity is even considerably higher in some cases.

To perform the second method described above, with a variable slice thickness, the literature has suggested a piling unit which collects or piles the cut slices on a paddle and then places the pile on a conveyor for carrying off the portions when the cutter blade of the cutter unit has cut the last slice of the portion and it has been placed on the pile. The piling unit together with the paddle is disposed on the weigher unit.

A disadvantage of this apparatus proposed in the literature is that the collecting or piling and the subsequent placing of the slice portion on the conveyor by means of the paddle cannot be carried out with sufficient speed, so that this part of the apparatus is a bottleneck in comparison with the cutter unit and prevents the otherwise attainable capacity of the apparatus from being achieved.

A further disadvantage of this known system is that the cut slices fall or tip on to the paddle. In the case of products such as bread or meat etc. this means that the slices making up the portions are not piled flush with one another in the way required or at least highly desirable for subsequent packing.

SUMMARY OF THE INVENTION

The object of this invention is to improve the known devices of the above-described type while obviating their disadvantages, and provide a device or part-device of this kind or similar whereby the product in slice form can be made up into very accurate portions as regards weight by fully mechanical or automatic operation without any need for manual intervention and without the disadvantage thereof. At the same time, the capacity or output is to be equivalent at least to the cutting capacity of conventional cutting units for such purposes so that the resulting capacity can be fully utilized for making up the portions. In addition, the portions are to be made up of slices which are substantially in line or flush with one another without any corrections in this respect after cutting. The device according to the invention will also allow automatic selection of unsuitable slices (e.g. the crusts) while at the same time the device according to the invention can be used for products of the most diverse form in respect of height, width, and configuration, so that tin loaves and freely baked bread can be processed using one and the same device. Finally, the device according to the invention is to guide the product right up to the cutter blade in such manner that all the slices of suitable shape really are used for making up portions and do not have to be rejected because of deficient guidance as is the case in known devices of this type.

To this end, according to the invention, the reception unit is constructed in the form of a turret comprising a plurality of stations.

The turret pivot axis preferably extends horizontally although in principle it would be possible for it to extend differently, e.g. for the turret to have a vertical pivot axis.

To embody the required high capacity of the device without difficulty, as will be explained hereinafter, the turret preferably has a plurality of reception arms which, according to a preferred embodiment of this invention, have equal angle spacing so that two adjacent reception arms each include the same angle.

It has been found very advantageous for the turret to have four reception arms, although it is possible, of course, to use a different number of reception arms.

At their end portion remote from the turret pivot axis, the recpetion arms each have a kind of reception pocket, and the arrangement may advantageously be such that the reception pocket of a reception arm in its reception position is substantially in line with the conveying or longitudinally axis of the feeder.

To ensure that the cut slices are securely received in the reception unit, it is preferably provided with a plurality of reception pins on which the slices of each portion are pushed after cutting, and it is of course advantageous for the free ends of the pins to be pointed. The reception pins may be disposed with horizontal and/or vertical spacing above the reception base of the reception pocket in question, on a back wall or the like of the reception pocket and extend substantially parallel to the reception base of the reception pocket, which base extends in parallel or in alignment with the feeder when in the reception position.

In a preferred development of the invention, the reception arms are each provided with a pusher through which extend the reception pins of the reception arm in question and which may, if required, be guided thereon.

As will be explained hereinafter with reference to the exemplary embodiment, it is particularly advantageous for the pusher of the reception arm to be rigidly connected to the pusher of the opposite reception arm in line with the reception arm in question, so that it is possible to arrange for the pusher of the reception arm in the reception position to be in its radially inward limit position when the pusher of the opposite reception arm aligned therewith is in a radially outward limit position, in which it is pushed out to such an extent that the free end portion of the reception pins no longer engage in the portion slices.

The reception unit is preferably driven intermittently, advantageously by being rotated about its pivot axis through the pitch angle between two adjacent reception arms during each working cycle. This can be effected in various ways. Preferably, the reception unit drive is actuated under the control of a counter unit provided for counting the slices delivered to the reception unit and preferably disposed near the cutter unit, and this can be effected, for example, by a light barrier provided near the cutter blade, a cam switch or the like, a transmitter of this kind transmitting pulses per unit of time to a counter mechanism which, when a predetermined number of slices has been reached, delivers a pulse to the control system for the reception unit drive, which may, for example, be constructed as a stepping motor to ensure a corresponding rotary or pivoting movement of the reception turret about its pivot axis.

As already stated, the conveying run of the conveyor may be positively connected in a known manner to the product and, for example, be constructed as a spiked chain conveyor or the like. It is of course also possible, for example, for the feed power required to be applied by a piston or the like, without the product receding as the cutter unit operates, the said piston acting on the end of the product or a row of products and advancing them on a support in the direction of advance, and a lateral guide may also be provided in addition. The feeder constructed as a continuous conveyor with an endless conveyor run, however, obviously has the advantage that products for cutting can be continuously fed to the feeder, and this is not the case in the case of a feeder having a piston drive, since the piston has to be retracted each time after a specific operating period.

A presser unit acting one the top of the product is disposed above the feeder, which is preferably driven intermittently for the reasons indicated hereinafter. The presser unit is preferably vertically adjustable so that it can be adapted to different average product heights. The presser unit is preferably pressed against the product by resilient components. Leaf springs can be used in known manner for this purpose for example. However, the presser unit, like the actual feeder, is preferably constructed, for example, as a spiked chain conveyor or the like so that the presser unit co-operates positively with the top of the product and accordingly ensures perfect guidance of the product up to the cutting plane.

The cutter unit is preferably provided in known manner with a circular cutter or sickle-shaped blade of known construction, which may be epicyclic and have its own drive as already described briefly hereinbefore. However, a cutter or blade of this kind is not obligatory for this invention and may, for example, be replaced by one or more other cutting elements, e.g. a cutting wire or the like.

In another embodiment of the cutter unit, for example, a group of mutually spaced cutting elements is provided which, when the conveyor is stationary, are lowered from above on to the end of the product for cutting and cut the same, after the end of the product projecting beyond the feeder has been pushed on to a cutting plate situated immediately in front of the reception unit, the polished top of the cutting plate which faces the product and consists of a hard material being formed with reception grooves for the cutting elements lowered on to the product so that complete cutting through of the product is ensured without the cutting elements coming into contact with the cutter plate. With this embodiment of the cutter unit, a number of slices corresponding to the number of cutting elements is pushed off by the advance movement of the feeder, when the latter has been restarted, after the cutting elements have been withdrawn upwardly or removed laterially from the zone of the slices. The distance between adjacent cutting elements which corresponds to the slice thickness is preferably adjustable to allow the above-mentioned control or regulation of the portion weight by way of the slice thickness, and obviously it is not necessary to change the spacing between all the cutting elements; basically it will be sufficient to alter the spacing between two cutting elements.

If the cutter unit is provided with a circular blade or the like as is described hereinbefore, the arrangement is advantageously such that the substantially vertically extending cutting plane of the circular blade is situated immediately in front of the head of the feeder and tangentially immediately in front of the circle described by the free ends of the reception arms of the reception unit.

The reception pins are preferably so long that when the associated reception arm of the reception unit is in the reception position they extend right up to the cutting plane of the circular blade in order thus reliably to receive and hold all the slices of a portion—including the last slice of the portion.

The weighing unit is advantageously constructed as a belt weigher and disposed downstream of the conveyor which feeds it the rear station of this conveyor, which is constructed as a belt conveyor or the like, preferably being fed directly by the reception unit. The weighed portion can then be transferred by the weighing unit to the actual conveyor for carrying off the portions, which finally delivers them to the packing station.

Since there is no need for a positive connection between the slices of the portion and the conveyor on the conveyor feeding the belt weigher, the belt weigher and the conveyor carrying the portions off, and in fact such a positive connection might obstruct handling, these three conveyors can be constructed as belt conveyors or the like and accordingly are not only simple in construction and correspondingly cheap but in addition are operationally reliable and require little maintenance.

For the purpose of selecting the slices which are not suitable for making up portions, e.g. the crusts or the like at the ends of the product, in a preferred embodiment of the invention a sensor system is provided, by means of which the height level of the top of the product supplied by the feeder can be measured. The free end of the sensor system may have a pivoting arm provided with a sensing roller or the like, and the angle of pivoting of the arm corresponding to the product height and hence the slice height can be measured automatically.

Alternatively, the sensor system may have, for example, a sensing head or the like which is supported displaceably against a resilient restoring force.

It is also proposed that the sensor system should automatically switch off the feeder drive if a predetermined minimum value is not attained and automatically switch it one again after the said minimum value has been exceeded.

Also, if the said minimum value is not attained, the sensor system causes the reception pocket or the like of the reception arm in the reception position to be automatically withdrawn from the cutting plane of the cutter unit and, if the minimum value is exceeded, automatically to be pushed back into the reception position. Consequently, the slices of inadequate height which are unsuitable for making up portions are not introduced into the reception unit, but drop into a chute which is provided to receive reject slices of inadequate height and, preferably, feeds a reject conveyor which automatically feeds the reject slices to a collecting station.

To enable the crusts to be selected as rejects even in the case of products whose cross-sectional shape is constant to approximately the ends of the product—unlike, for example, freely baked bread, as compared, for example, with tin loaves, a suitable transmitter may be provided near the head section of the feeder or near the cutting plane to detect the end of a first product or the start of the next second product and, if required, automatically switch off the feeder drive for a short period or withdraw for a short period the reception arm pocket or reception unit arm in the reception position, so that such end slices are reliably rejected. A light barrier is particularly suitable as a transmitter of this kind, its light passing through a small or narrow gap between two successive products and accordingly being able to ensure the required selection with reliable operation.

DETAILED DESCRIPTION OF THE PREFERRED EMBODIMENTS

Figure 1:
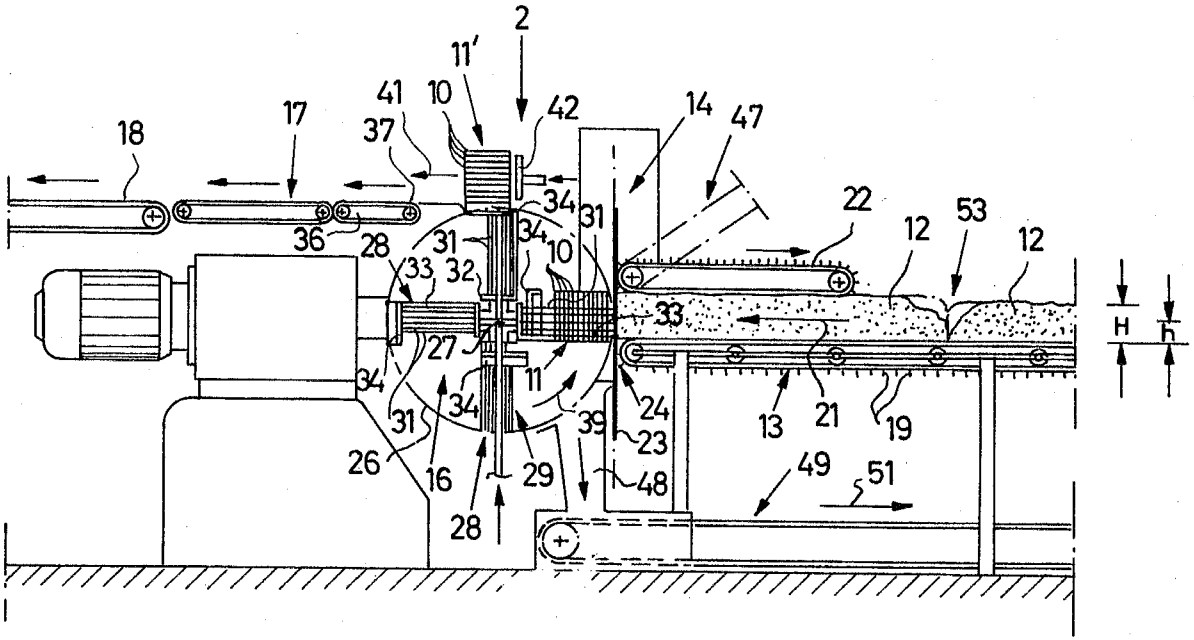
FIG. 1 is a partial side elevation of a highly simplified or schematic device for making one-pound cut-bread portions for packing from loaves, viewed in the direction of the arrow I in FIG. 2.
Figure 2:
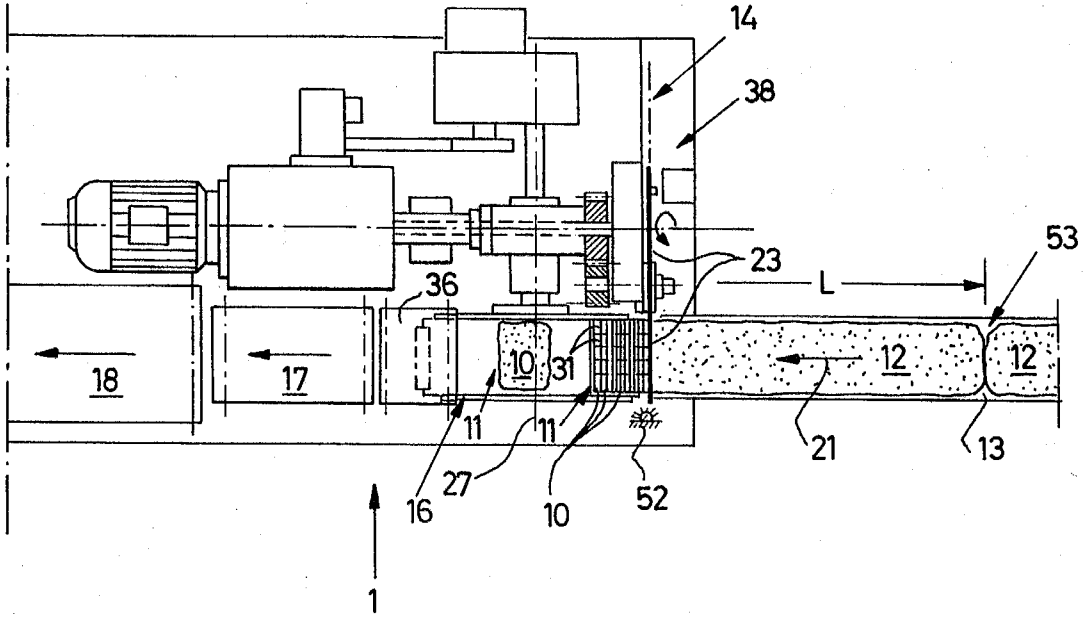
FIG. 2 is a plan view of the device shown in FIG. 1, in the direction of the arrow II in FIG. 1.

FIGS. 1 and 2 of the drawing show a device for making portions 11 of a specific weight and consisting of a number of slices 10, and more specifically for making one-pound cut bread portions for packing the portions being cut from loaves 12.

The device comprises an intermittently driven feeder 13 for supplying the loaves 12, the speed of delivery or advance being controllable, and a cutter device having the general reference 14 is disposed at the head of the feeder.

The cutter device 14 is followed by a reception unit having the general reference 16 for receiving each batch of slices 10 of a cut-bread portion 11.

The reception unit 16 is in turn followed by a weighing unit having the general reference 17, for weighing each portion 11, and the speed of advance of the feeder 13 is controlled by means of this unit as will be explained hereinafter.

Finally, unit 17 is followed by a conveyor 18 for carrying off the weighed portion 11 to a packing station (not shown).

The feeder 13 is in the form of a spiked chain conveyor, the spikes 19 of which project perpendicularly from the top and bottom runs, so that the loaves 12 supplied on the feeder 13 and moving in the direction of the arrow 21 are positively connected to the feeder 13 and are fed firmly thereon during their transport.

The feeder drive (not shown) is of intermittent construction.

A presser system 22 also constructed as a spiked chain conveyor is disposed above the top run of the feeder 13 and in spaced relationship therefrom, the distance from the top of the feeder 13 being adjustable, and this unit is pressed resiliently against the top of the loaf 12 by means of springs (not shown).

Cutter unit 14 comprises an epicyclic cutter blade 23. The substantially vertical cutting plane of the blade 23 is situated immediately in front of the head 24 of the feeder 13. It is also situated tangentially directly in front of the circle 26 shown by a chain-dotted line in the drawing, this circle being described—as will be explained hereinafter—by the free ends of reception arms of the reception unit 16 as they rotate about their pivot axis 27.

The drive for the cutter unit 14 is shown more particularly in FIG. 2 and will not be described in greater detail here since it is known and does not form the subject matter of this application.

The reception unit 16 for receiving each portion 11 of slices of bread 10 is constructed after the style of a turret comprising a number of stations, the pivot axis 27 extending horizontally.

The reception unit or turret 16 comprises four reception arms having the general reference 28, these arms being spaced by equal angles so that there is of course a right angle between each two adjacent reception arms 28. The reception unit 17 is driven intermittently as already indicated above and as will be explained in detail hereinafter.

At each end portion remote from the turret pivot axis 27, the reception arms 28 each have a reception pocket 29 which, in the reception position (the right-hand reception arm 28 in FIG. 1), is in line with the longitudinal axis or direction of conveyance 21 of the feeder 13, as will be apparent particularly from FIG. 1 of the drawing.

Each reception arm 28 comprises a plurality of rows of spaced reception pins 31 of relatively small diameter, which are disposed side by side and one above the other and on which the slices 10 of each portion 11 are pushed after cutting, as will be described in detail hereinafter. The outer free end of the pins 31 tapers and the pins are secured by the opposite end in each case to a wall 32 of the reception arm 28, and from there they extend in parallel relationship to the base 33 of the associated arm 28 or pocket 29.

The arms 28 are also each provided with a pusher 34 through which the pins 31 of the associated arm 28 extend, and at the same time guide the pusher 34 to some extent.

The pusher 34 of each arm 28 is rigidly connected to the pusher 34 of the opposite reception arm 28 in line with the arm 28, the arrangement being such that the pushers 34 of aligned reception arms each have a constant distance from one another so that the pusher 34 of the arm 28 in the reception position is in its radial inward limit position when the pusher 34 of the opposite arm 28 in line therewith is in a radially outer limit position as will be clearly seen from FIG. 1 of the drawings.

The pins 31 of the arm 28 in the reception position (the right hand arm 28 in FIG. 1) of the reception unit 16 extend as far as the cutting plane of the blade 23 so that the slice cut by the cutter unit 14 is always guided or held in the optimum manner before being separated from the loaf 12.

The weighing unit 17 is constructed in the form of a belt weigher and is preceded by a belt conveyor 36, the rear station 37 of which is fed by the reception unit 16 as will be described in detail hereinafter.

The system described above and shown in FIGS. 1 and 2 operates as follows:

The loaves 12 are placed on the top run of the feeder 13, although this is not shown, so that successive loaves 12 are in immediate contiguous relationship. The spikes 19 of the feeder 13 engage in the underside of the loaves 12 so that there is a positive connection between the loaves 12 and the feeder 13 and the latter can guide the loaves 12 while advancing them to the cutter 14, and holding them when the cutter blade 23 engages the cut end of the loaf 12 in order to cut a slice.

The speed of rotation of the cutter blade 23, and hence the cutting frequency, is very high, being about 500 to 550 rpm or a corresponding number of slices per minute, so that 8 to 9 slices are cut per second and the cutting operation for a one-pound portion is thus only about 1.5 seconds, since a pound of bread in the most usual types of bread and with the usual slice thickness consists of about 12 to 13 slices. The 1.5-second portion cycle can therefore be regarded as relatively low if we bear in mind that the one-pound portions are conveyed, checked, weighed etc. and finally packed during this approximate cycle time or a corresponding number of cycles.

As already stated, good guidance of the front loaf 12 is assisted by the presser unit 22, which is also constructed as a spiked chain conveyor and which ensures optimum guidance of the loaf to the usable end, in contrast to presser units constructed simply as loaf springs, so that the loaves can be practically completely used for slicing into portions.

The slices 10 cut by the blade 23 of the cutter unit 14 are automatically pressed on to the group of reception pins 31 by the following loaf 12 until the pre-determined number of slices 10, e.g. thirteen slices, is reached, the number being preselected by a counter 38 (see FIG. 2), which is disposed on the cutter unit 14 and is controlled by the reception unit drive so that after the set number of slices has been counted in a counter (not shown), i.e. after one working cycle, the turret unit 16 is pivoted through 90° in the anticlockwise direction, i.e. in the direction of arrow 39, about the pivot 27.

After this indexing movement, the portion 11 reaches the position 11' at the top in FIG. 1, in which the previously vertical slices 10 are now situated one above the other in a horizontal plane.

In the above-mentioned position of the portion 11', the pins 31 are withdrawn from the slices 10 or the slices 10 are stripped off the pins 31.

This is effected by means of the pusher 34 which is driven appropriately by known cam and follower means, for example (not shown), and has been moved, during the movement of the associated arm 28, from its reception position (on the right in FIG. 1) to its delivery position (the top in FIG. 1), from its radially inward limit position to its radially outward limit position, during which its strips the slices 10 off the pins 31 and at the same time moves the pusher 34 of the arm 28 situated in alignment and therebeneath, out of its radially outward limit position into its radially inward limit position, which is of course necessary in the next reception position for this reception arm 28.

The slices 10 of the portion 11' are then delivered from the now upwardly directed arm 28 to the conveyor 36 and then on to the weighing unit 17 which is constructed in the form of a belt weigher. There are various ways in which the portion 11' which has been moved upwards in the direction of arrow 39 and which has been stripped off the pins 31 by means of the pusher 34 acting as a stripper, can be transferred to the conveyor 36 in the direction of arrow 41. A pusher or piston 42 may be used, for example, and is shown symbolically in FIG. 1 of the drawing.

Figure 3:
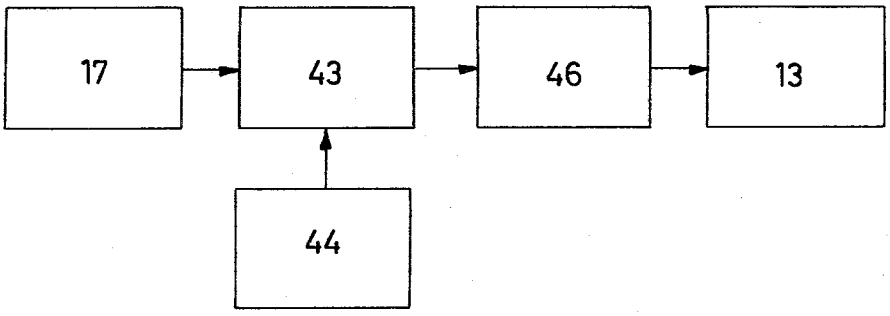
FIG. 3 is a simplified block diagram for one possible portion weight control in the device according to FIGS. 1 and 2.

The actual weight of the portions 11 or 11' are then determined on the belt weigher 17. The corresponding signal is transmitted from the weigher unit 17 to a comparator 43 (see block schematic in FIG. 3), which also receives the signal from an adjustable set-value transmitter 44. The comparator 43 passes a control signal to the control system 46 of the feeder 13 to leave the drive for the feeder 13 or the speed of advance thereof unchanged it the actual value corresponds (substantially) to the set-value, but increases the speed of advance if the actual value of the measured weight of the portions is too small, and reduces the speed of advance of the feeder 13 if the set weight of the portion is excessive.

The slice thickness does not change immediately, for example, if a portion 11 or 11' having simply a 20 g underweight or overweight reaches the weigher unit 17, because the control circuit would practically never come to rest if every small random change in weight immediately resulted in adjustment. On the contrary, the control system is preferably such as to respond basically to changes in trends. Consequently, the slice thickness control system is not operated until, for example, three portions having a weight either below the bottom tolerance limit or above the top tolerance limit have been recorded by the unit 7.

The blade 23 of the cutter unit 14 is rotating constantly and is not braked, for example, after each portion 11 has been made. This is advisable because otherwise the relatively large fly-wheel masses would have to be continuously accelerated and decelerated, and this would be practically impossible in any case in view of the high cutting speeds.

Instead of this it is much more advantageous to stop the feeder 13 for brief periods during the given cycle, because the feeder does not have an excessively high speed and has no large moving masses as is the case with the cutter unit 14, the kinetic energy content of which is already very high because of the high speed.

A sensor system having the general reference 47 is provided to allow particularly for loaves where the end slopes away and to enable slices unsuitable for making up portions to be separated if their height is much less than the average height H of the loaf 12 and below a bottom limit h. This sensor system measures the level of the height of the top of the loaf 12 supplied by the feeder 13. The sensor system which is shown only diagrammatically in FIG. 1 of the drawing, comprises a sensing roller at its free end adjacent the loaf 12 to trace the surface contour of the loaf and automatically shut off the drive for the feeder 13 for a brief time if the pre-set minimum value is not attained, so that the slice or slices not intended for forming portions can be selected during that period. The sensor system 47 also ensures that the reception arm 28 or pocket 29 in the reception position is withdrawn for a short period to clear the path for reject slices to be discharged.

For this purpose, a reception chute 48 is provided beneath the reception unit 16 near the cutter unit 14, to receive reject slices of inadequate height, which pass through the chute to the rear station of a reject conveyor 49, which conveys them in the direction of arrow 51 to a collecting station (not shown).

A transmitter 52 in the form of a light barrier is also provided near the head portion 24 of the feeder 13 to detect the two consecutive ends of consecutive loafs 12 if this is not possible by means of the sensor system 47, as is the case, for example, with tin loaves. Even in the case of tin loaves of the kind shown by chain-dotted lines in FIG. 1 (the continuous lines represent loaves in contact with one another), light penetrates, in the region of the contact point 53, to a selenium cell (not shown) which is situated on the other side, so that a light barrier is formed which switches off the drive for the feeder 13 for a short period and also causes the reception arm 28 or its pocket 29 in the reception position to be withdrawn for a short period so that the crusts which are not suitable for forming portions pass to the reception chute 48 and can be discharged via the reject conveyor 49.

For the sake of clarity, FIG. 2 does not show all the parts shown in FIG. 1, and vice versa. For example, the presser 22 and the sensor system 47 have been omitted from FIG. 2 while certain parts of the drive shown in plan view in FIG. 2 have been omitted from FIG. 1.

Figure 4:
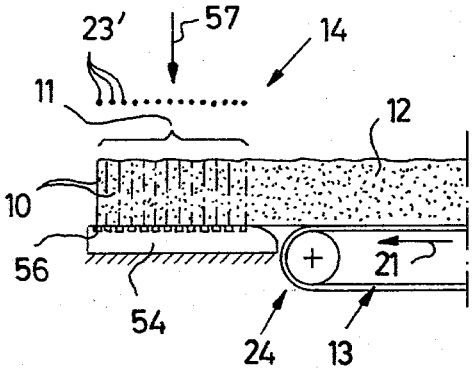
FIG. 4 is a highly diagrammatic variant of a cutter unit for a device as shown in FIGS. 1 and 2.

FIG. 4 of the drawing shows a variant of the cutter unit 14 which, in the embodiment shown in FIG. 4, comprises a plurality of cutter elements 23' which are shown simply in the form of spaced dots in the side elevation in FIG. 4. The cutter elements 23 may be members in the form of knives, cutting wires or other cutting elements.

Following the feeder 13 in the direction of conveyance 21 is a cutter plate 54 situated beneath the cutter elements 23' and consisting of a hard and wear-resistant material having a smoothly polished surface and acting as an abutment for the cutter elements 23' or the bread 12. The somewhat spherical top of the cutter plate 54 can be formed with grooves 56 each disposed in line beneath a cutter element 23' so that the latter, or its bottom edge, can move into the associated groove 56 as the cutter elements 23' are lowered, i.e. as the front end of the loaf 12 is cut, without striking the top of the cutter plate 54 and thus becoming blunted.

This cutter unit operates as follows:

The loaf 12 is fed beyond the head 24 of the feeder 13 by its end corresponding substantially to a portion 11 so that the underside of the projecting end rests on the cutter plate 54. The cutter elements 23' of the cutter units 14 are then lowered in the direction of arrow 57 and cut through the loaf 12 so that a specific number of, for example, thirteen slices corresponding to a portion 11 is formed simultaneously.

If the cutter elements 23' are cutter wires or the like which pass fully into the grooves 56 after the cutting operation, the feeder 13 can be advanced a specific amount immediately after the cutting operation and push the slices 10 of the resulting portion 11 on to or in to the reception unit 16 (not shown in FIG. 4). The cutter elements 23' are then moved upwards in the opposite direction to arrow 57 before the operation is repeated, or else the cutter elements 23' cut the slices 10 for the next portion 11 from below, although in that case an abutment would have to be provided at the top.

The cutter elements 23' may correspondingly, of course, also be cutter blades disposed in parallel relationship, the complete group of blades cutting one portion at a time.

To enable the portion weight to be varied by means of the slice thickness with a cutter system of this kind, the distance between adjacent cutter elements 23' is variable, although it is of course sufficient if this is the case just for a few, or just a single pair of cutter elements 23'.

What is claimed is:

1. A device for making sliced portion of specific weight from a cuttable product, such as one-pound cut-bread portions for packing from loaves, comprising:
   (a) a product feeder,
   (b) means for controlling the speed of advance of the product feeder,
   (c) a cutter unit at a head section of the product feeder, said cutting unit including a cutter blade the substantially vertically extending cutting plane of which is situated immediately in front of the head of the product feeder,
   (d) a reception unit intermittently driven about a pivot axis and disposed near the cutting unit to receive the slices of at least one portion,
   (e) a weigher unit for weighing each portion, the controlling means being respective to the output of said weigher unit,
   (f) a conveyor for carrying off the weighed portions, and
   (g) the reception unit being constructed in the form of a turret comprising a plurality of reception arms spaced by equal angles, said reception arms each having a plurality of reception pins extending in the direction of each reception arm, on which, in a reception portion of a reception arm, the slices of a portion are each pushed after cutting, and each reception arm further having a pusher guided on said reception pins for automatically removing the slices from the pins, whereby during each working cycle the turret is rotated about its pivot axis by an amount equal to the pitch angle between two reception arms.

2. A device according to claim 1, wherein the pivot axis (27) of the turret (16) extends horizontally.

3. A device according to claim 1, wherein the turret has four reception arms.

4. A device according to claim 1, wherein the reception arms each have a reception pocket (29) at their end portion remote from the turret pivot axis, whereby the reception pocket of a reception arm when in its reception position is substantially in line with the longitudinal axis or direction of conveyance (21) of the feeder (13).

5. A device according to claim 4, wherein the reception pins are disposed with horizontal and vertical spacing between them.

6. A device according to claim 5, wherein the reception pockets each have a reception base (33) and a wall (32) and wherein said horizontally and vertically spaced reception pins are secured on the wall and extend substantially parallel to the base of the reception pocket.

7. A device according to claim 1, wherein the pusher of a reception arm is connected to the pusher of the opposite reception arm in line with the first reception arm.

8. A device according to claim 7, wherein the pushers of aligned reception arms are so disposed that the pusher of the reception arm in the reception position is in its radially inward limit position when the pusher of the opposite aligned reception arm is in its radially outward limit position.

9. A device according to claim 1, wherein said feeder comprises a conveying run which is positively connected to the product (12).

10. A device according to claim 9, wherein the feeder is constructed as a spiked chain conveyor.

11. A device according to claim 10, wherein the feeder is driven intermittently.

12. A device according to claim 1, wherein a presser unit (22) acting on the top of the product is disposed above the feeder.

13. A device according to claim 12, wherein the presser unit is vertically adjustable.

14. A device according to claim 12, wherein the presser unit is resiliently pressed against the product for cutting.

15. A device according to claim 14, wherein the presser unit is constructed in the form of a spiked chain.

16. A device according to claim 1, wherein the substantially vertically-extending cutting plane of the cutter blade is situated tangentially immediately in front of a circle (26) described by the free ends of the reception unit arms.

17. A device according to claim 16, wherein the weigher unit is constructed as a belt weigher.

18. A device according to claim 17, wherein the weighing unit is preceded by a conveyor (36).

19. A device according to claim 18, wherein the rear station (37) of the conveyor (36) is fed by the reception unit, said conveyor being constructed as a belt conveyor.

20. A device according to claim 19, wherein the weigher unit transfers the weighed portions (11 or 11') to a further conveyor (18) for carrying off the portions.

21. A device according to claim 20, wherein the further conveyor (18) for carrying off the weighed portions is constructed as a belt conveyor.

22. A device according to claim 21, wherein a sensor system (47) is provided for measuring the height level (H) of the top of the product (12) supplied by the feeder.

23. A device according to claim 22, wherein the sensor system comprises a pivoting arm, the free end of which is provided with a sensing roller and the pivoting angle of which is measured automatically.

24. A device according to claim 23, wherein the sensor system switches off the drive for the feeder automatically when a predetermined minimum value (h) is not attained and automatically switches it on again after the predetermined minimum value (h) has been exceeded.

25. A device according to claim 24, wherein when a predetermined minimum value (h) of the height (H) of the product is not attained the sensor system (47) automatically withdraws from the cutting plane of the cutter unit the reception arm in the reception position, and automatically pushes it back into the reception position when the minimum value (h) is exceeded.

26. A device according to claim 25, wherein a reception chute (48) to receive rejected slices of inadequate height is provided beneath the reception unit near the cutter unit.

27. A device according to claim 26, wherein a reception arm is pushed out of the reception position into a non-reception position without pivoting the turret about its pivot axis.

28. A device according to claim 27, wherein a transmitter (52) is provided near the head portion (24) of the feeder to detect the end of a first product or the beginning of an adjacent second product and, if necessary, switch off the drive to the feeder automatically for a brief time and withdraw the reception arm in the reception position from the cutting plane.

29. A device according to claim 1, wherein a counter unit (38) is provided for counting the slices passed to the reception unit, whereby the drive for the reception unit is actuated under the control of the counter unit.

* * * * *